United States Patent [19]

Saito

[11] Patent Number: 4,932,838

[45] Date of Patent: Jun. 12, 1990

[54] FLUID APPARATUS

[75] Inventor: Takeshi Saito, Yokohama, Japan

[73] Assignee: Ishikawajima-Harima Heavy Industries Co., Ltd., Tokyo, Japan

[21] Appl. No.: 289,166

[22] Filed: Dec. 23, 1988

[51] Int. Cl.[5] ..... B63H 1/24

[52] U.S. Cl. ..... 416/140; 416/131

[58] Field of Search ..... 440/50; 416/131 R, 136 R, 416/139 R, 140 R; 415/123, 122.1

[56] References Cited

U.S. PATENT DOCUMENTS

| | | | |
|---|---|---|---|
| 2,134,157 | 10/1938 | Thompson | 416/140 R |
| 2,160,745 | 5/1939 | Levy | 416/140 R |
| 2,352,186 | 6/1944 | Corrigan | 416/140 R |
| 2,869,648 | 1/1959 | Pihl | 416/131 R |
| 4,047,841 | 9/1977 | Laurin | 416/131 R X |
| 4,140,434 | 2/1979 | Bianchi | 416/140 R |
| 4,515,511 | 5/1985 | Heerlein | 416/131 R |

FOREIGN PATENT DOCUMENTS

| | | | |
|---|---|---|---|
| 1033837 | 7/1958 | Fed. Rep. of Germany | 416/131 R |
| 1198700 | 8/1965 | Fed. Rep. of Germany | 440/50 |
| 2523673 | 12/1976 | Fed. Rep. of Germany | 416/140 R |
| 3618183 | 8/1987 | Fed. Rep. of Germany | 416/140 R |
| 25733 | 5/1952 | Finland | 416/140 R |
| 2555121 | 5/1985 | France | 416/131 R |
| 8150 | 3/1970 | Japan | 416/131 R |
| 987196 | 1/1983 | U.S.S.R. | 416/139 R |
| 467488 | 6/1937 | United Kingdom | 416/140 R |
| 719967 | 12/1954 | United Kingdom | 416/139 R |
| 1414362 | 11/1975 | United Kingdom | 416/140 R |
| 1579493 | 11/1980 | United Kingdom | 416/140 R |

*Primary Examiner*—Edward K. Look
*Assistant Examiner*—John T. Kwon
*Attorney, Agent, or Firm*—Dykema Gossett

[57] ABSTRACT

A fluid apparatus comprising a motor, a blade wheel connected to the motor shaft, plural moving blades disposed along the outer circumference of the blade wheel with each moving blade shaft extending into the blade wheel and being rotatable relative to the blade wheel, small gears attached to the moving blade shaft inside the blade wheel, a large gear disposed to be level with the blade wheel so as to be geared with the small gears, an impeller connected to the large gear and housed in a casing with oil so that there may be produced a relative angle difference between the blade wheel and the large gear upon starting of the blower, and stoppers for stopping the large gear at predetermined positions with respect to the blade wheel at normal and reverse modes of the blower respectively.

14 Claims, 4 Drawing Sheets

FLUID APPARATUS

BACKGROUND OF THE INVENTION

1. Field of the Invention

This invention relates to a fluid apparatus, more specifically a blower which can ventilate in opposite directions.

2. Background Art

Ventilation is necessary by means of a fluid apparatus such as an axial flow blower, for example, in a tunnel 81 at a highway, as shown in FIG. 8 of the accompanying drawings. The blower 82 sends wind up and down the road in accordance with traffic volume and atmospheric pressure at the entrance and the exit of the tunnel 81, so that the tunnel 82 is ventilated effectively and economically.

Two types of blowers have been widely known for such ventilation. One is, as shown in FIG. 9, a blower provided with fixed moving blades 91 of rectangular section. This blower sends wind bidirectionally by only changing the direction of rotation of a blade wheel (not shown) which the blades 91 are attached to. The other one is, as shown in FIG. 10, a blower with rotatable moving blades 101 of streamline section. When changing the direction of ventilation by this blower, the blade wheel is rotated in a reverse sense and the blades 101 are also rotated about their respective axes approximately 180 degrees. However, in the former case, the moving blade has a rectangular section so that the resulting noise is large and ventilation efficiency is low. In addition, it consumes electric power nearly 10% more than the latter blower. On the other hand, in the later case, a complicated drive mechanism (not shown) is required to rotate the moving blades 101 about the axes thereof. Thus it is very costly.

SUMMARY OF THE INVENTION

This invention eliminates the above-mentioned drawbacks of the conventional blowers and provides a fluid device which is capable of rotating the moving blades to optimum position automatically by a simple mechanism.

According to a first aspect of this invention, there is provided a blower comprising a motor and a blade wheel fixed to the shaft of the motor. Along the outer circumference of the blade wheel, plural moving blades are provided. Each blade has a shaft extending into the blade wheel so that the blade may rotate about its shaft. A small gear is disposed at the end of the shaft, and there is provided a large gear engageable with the small gears. The large gear is disposed to be level with the motor. The large gear has a shaft extending out of the blade wheel and to the end thereof there is attached an impeller. The impeller is housed in a casing filled with oil. There are formed one projection within the large gear and two stoppers within the blade wheel so that the rotation of the blade wheel may be limited by those stoppers and the projection. The stoppers and the projection are positioned in a manner such that the large gear is stopped at predetermined positions in the normal mode and the reverse mode of the blower, respectively. The impeller, the casing to house the impeller, and the oil in the casing serve in combination as damping means which cause the large gear to delay relative to the blade wheel so that there may appear a relative angle difference therebetween.

According to the blower of the above construction, as the blower is turned on, the blade wheel land the large gear both start rotating. However, the damping means applies a resistance force against the large gear, so that there appears an angle difference between the large gear and the blade wheel. Meanwhile, inside the blade wheel, each small gear starts rotating and therefore each moving blade rotates about the axis thereof. In short, the moving blades begin rotating about the axes thereof when the blower is turned on. Each blade rotates clockwise or counterclockwise, depending on the switch mode of the blower. Each blade automatically stopps rotating at an potimum position which is determined by the stopper of the large gear and the projection of the blade wheel.

According to a second aspect of the present invention, there is provided a blower comprising a motor and a blade wheel which is disposed to the shaft of the motor. Along the outer circumference of the blade wheel, plural moving blades are disposed. Each blade has a shaft extending into the blade wheel so that the blade may rotate about its shaft. A small gear is disposed at the end of said shaft inside the blade wheel, and there is provided a large gear to be engaged with the small gears inside the blade wheel. The large gear is disposed to be level with the motor. The large gear has a shaft extending out of the blade wheel, and there is provided an impeller near the large gear shaft so that between the large gear shaft and the impeller there is provided an electromagnetic clutch to disconnect and connect these two to each other. The impeller is housed in a casing filled with oil. One projection is formed within the large gear while two stoppers are formed within the blade wheel so that the large gear may be stopped by such stoppers and the projection. The stoppers and the projection are positioned in a manner such that the large gear is stopped at predetermined positions upon normal mode switching and reverse mode switching of the blower respectively. The impeller, the casing for the impeller, and the oil in the casing serve in combination as damping means which causes the large gear to rotate slower than the blade wheel, producing a relative angle difference therebetween.

As the blower is turned on, the electromagnetic clutch is automatically turned on to connect the large gear with the impeller. After the moving blades rotate to the optimum position and the motor reaches its rated rotating speed, the electromagnetic clutch is automatically turned off so as to disconnect the large gear from the impeller. The electromagnetic clutch connects the large gear with the impeller only when the moving blades are rotating about the respective shafts. Therefore, after completion of the rotation of the moving blades, no power is transmitted therebetween so that the impeller will eventually stop. This construction minimizes the loss due to the impeller.

According to a third aspect of this invention, a blower has a motor which has a gear at the extending end of its shaft. A blade wheel also has a shaft parallel to the shaft of the motor and extending toward the motor. At the end of the shaft there is provided a gear which is geared with the gear of the motor. Along the outer circumference of the blade wheel, plural moving blades are disposed. Each blade has a shaft extending into the blade wheel so that the blade may rotate about its shaft. A small gear is disposed at the end of each moving blade shaft inside the blade wheel, and there is provided a large gear to be engaged with the small gears. The large gear is disposed so as to be level with the blade wheel. The large gear has a shaft extending out of the blade wheel and at the end thereof there is attached an impeller. The impeller is housed in a casing filled with oil. There is formed one projection within the large gear while two stoppers are formed within the blade wheel so that the rotation of the large gear may be limited by those stoppers and the projection. The stoppers and the projection are positioned in such fashion that the large gear is stopped in the predetermined positions at normal mode and the reverse mode of the blower respectively. The impeller, the casing for the impeller, and the oil in the casing serve in combination as damping means which delays the large gear relative to the blade wheel so that there may appear a relative angle difference therebetween.

According to the blower of the above construction, as the blower is turned on, the motor, the blade wheel and the large gear start rotating in the blade wheel. In this case, the blade wheel rotates faster or slower than the blower motor because of the gear ratio between the two gears of thereof. Meantime, the damping means applies a resistance against the large gear, so that there is produced an angle difference between the large gear and the blade wheel. And at the same time inside the blade wheel, each small gear starts rotating and threfore each moving blade starts rotating about its own axis. Each blade automatically rotates clockwise or counterclockwise, depending on the switch mode of the blower. And each blade automatically stops rotating at an optimum position which is defined by the stopper of the large gear and the projection of the blade wheel.

The above aspects and other aspects of the present invention will be understood by reference to the following detailed description taken in conjunction with the accompanying drawings.

DESCRIPTION OF THE PREFERRED EMBODIMENTS

Now, preferred embodiments of this invention will be described with accompanying drawings.

Figure 1:
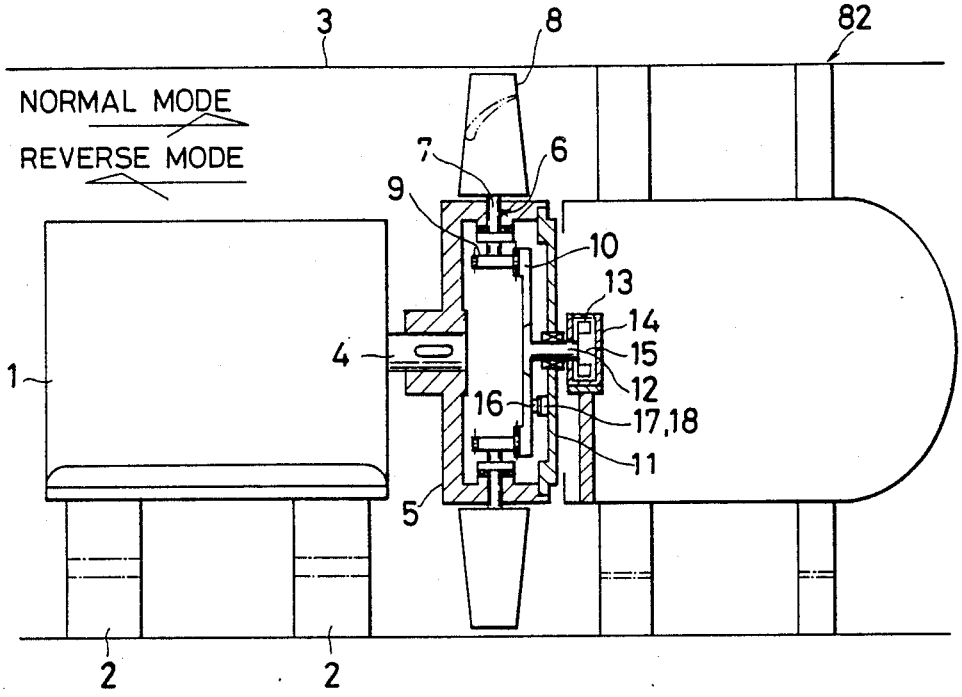
FIG. 1 is a view showing a construction of a blower of a preferred embodiment of this invention.

Referring to FIG. 1, a motor 1 of a blower 82 is disposed on support struts 2 at the center of the housing 3 of the blower 82. To the shaft 4 of the motor 1 there is provided a blade wheel 5. Plural through holes 6 are bored within the blade wheel 5 along the circumference thereof, and a shaft 7 is rotatably inserted in each through hole 6. At one end of each shaft 6, which is out of the blade wheel 5, there is provided a moving blade 8 of streamline section while at the other end thereof, which is inside the blade wheel 5, there is provided a small gear 9. A large gear 10 is rotatably disposed inside the blade wheel 5 parallel to the back wall 11 of the blade wheel 5 with its center being level to the motor shaft 4 so that it may be engaged with the small gears 9. At the external extending end of the shaft of the large gear 10 there is provided an impeller 13 which is accommodated in a casing 14. The casing 14 is fixed to the blower housing 3 and filled with oil 15. The impeller 13, the casing 14, and the oil 15 serve in combination as damping means which will be described later.

One projection 16 is formed at the back side of the large gear 10 while two projections 17 and 18 are formed at the front side of the back wall 11. The latter projections are called a normal mode stopper 17 and a reverse mode stopper 18 respectively. These stoppers 17 and 18 are located, as illustrated in FIG. 2, in a manner such that in normal mode, the large gear 10 may rotate to the optimum position for normal mode, namely it rotates until the normal mode stopper 17 encounters the projection 16 while in reverse mode the large gear 10 may rotate to the optimum position for reverse mode, namely until the reverse mode stopper 18 encounters the projection 16.

As the blower 82 is switched to the normal mode, the blade wheel 5 connected the motor shaft 4 starts rotating, and the small gears 9 and the large gear 10 start rotating as well. However, at the same time, the impeller 13 provided to the shaft 12 of the large gear 10 starts also rotating with oil 15 inside the casing 14, so that a resistance force is applied to the large gear 10 due to the oil 15 via the impeller 13. Therefore, the rotation of the large gear 10 delays relative to the blade wheel 5, and small gears 9 are rotated by the large gear 10 inside the blade wheel 5, rotating each moving blade 8 about respective shaft 7.

Figure 2:
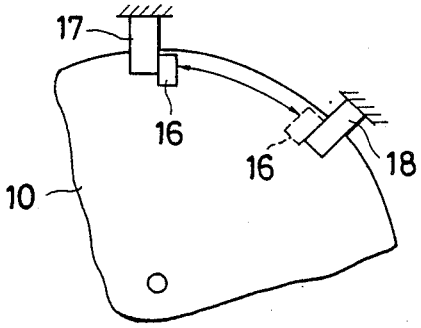
FIGS. 2 and 3(*a*), 3(*b*) are diagrammatic views to explain how the above embodiment functions.
Figure 3A:
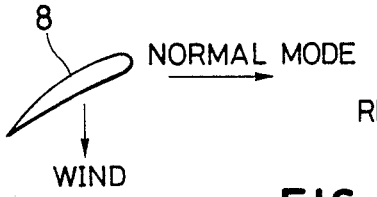
Figure 3B:
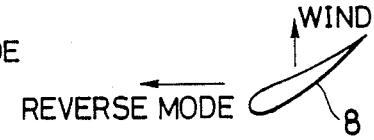

After that, as shown in FIG. 2, when the projection 16 of the large gear 10 meets the normal mode stopper 17, the relative movement between the blade wheel 5 and the large gear 10 stops, so that both of them 5 and 10 rotate together at the same speed. At this point, as shown in FIG. 3(*a*), each moving blade 8 has been set to the optimum position, and therefore effective ventilation is ensured.

In the reverse mode of the blower 82, the blower motor 1 is rotated a in reverse sense, along with the large gear 10. In this case also, as mentioned above, the large gear 10 rotates slower than the blade wheel 5 due to the resistance from the impeller 13. And, as depicted in FIG. 2, this relative movement continues until the projection 16 hits the reverse mode stopper 18. After that the large gear 10 and the blade wheel 5 rotate together, and as shown in FIG. 3(*b*), each blade 8 is inclined to the optimum angle for ventilation, so that it air most effectively. It may be appreciated from the above explanation that as the blower motor 1 starts rotating in the normal or reverse sense, the moving blades 8 are automatically rotated to the optimum positions thereby ventilating effectively.

Figure 4:
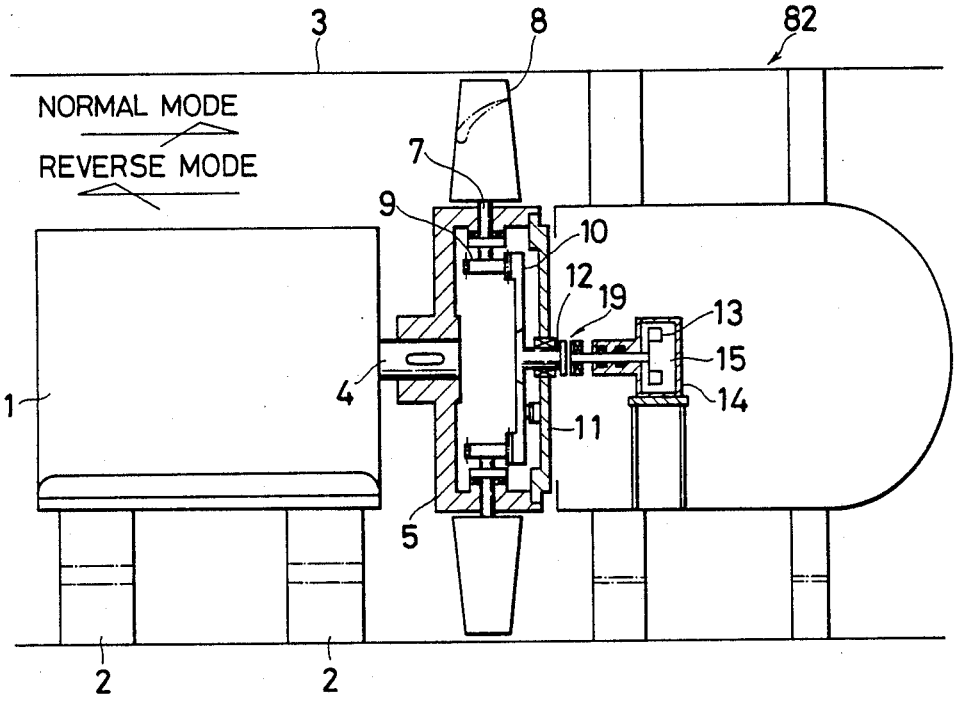
FIG. 4 is a view showing another embodiment of this invention.
Figure 5:
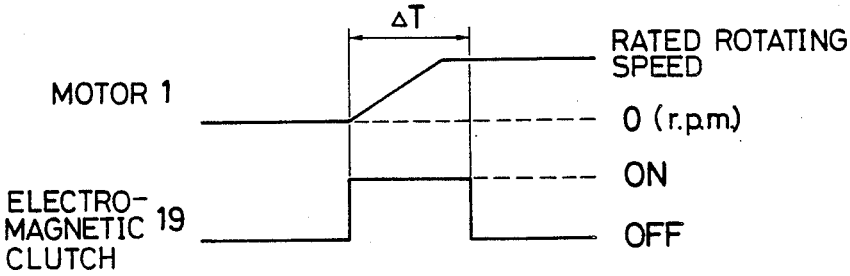
FIG. 5 is a timing chart depicting how the embodiment of FIG. 4 functions.
Figure 6:
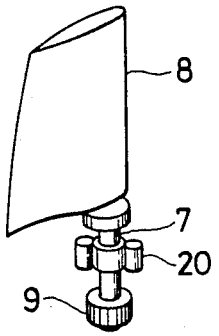
FIGS. 6 and 7 are views depicting in combination still another embodiment of the present invention.
Figure 7:
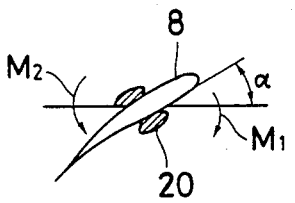
Figure 8:
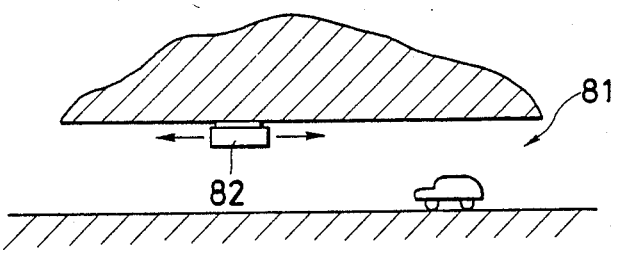
FIG. 8 is a schematic view of installation of a conventional blower.
Figure 9:
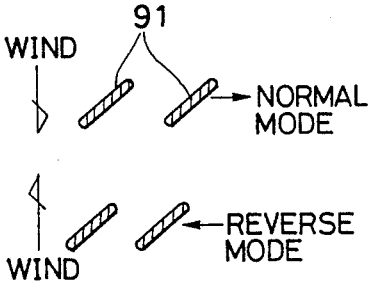
FIGS. 9 and 10 are views to explain problems of the prior art.
Figure 10:
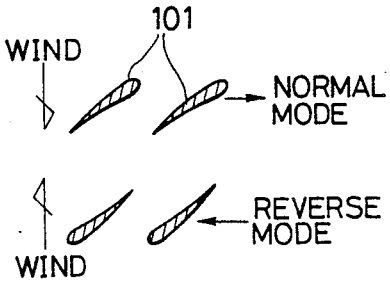

Referring now to FIG. 4 which illustrates another embodiment of this invention, there is provided an electromagnetic clutch 19 between the shaft 12 of the large gear 10 and the impeller 13 so that power transmission therebetween may be controlled. In this case, as shown in FIG. 5, the electromagnetic clutch 19 is turned on to connect the large gear 10 with the impeller 13 approximately at the time when the motor 1 is activated. And, as the motor 1 rotates, a resistance force is transmitted to the large gear 10 from the impeller 13, rotating the moving blades 8 to the optimum positions. At the completion of the blade rotation and after the motor 1 reaches its rated rotating speed, the electromagnetic clutch 19 is automatically turned off so that the large gear 10 and the impeller 13 are disconnected from each other. The electromagnetic clutch 19 is activated and deactivated automatically by a timer (not shown) so that the clutch 19 may be activated only ΔT. Therefore, the impeller 13 and the large gear 10 are connected to each other only while the moving blades are changing their angle, and once the motor 1 reaches its rated speed and the moving blades reach optimum positions, the impeller 13 is no longer driven by the blower motor 1 whereby it eventually stops. Accordingly, energy loss due to the resistance force by the impeller is minimized.

When the electromagnetic clutch 19 is off, the moving blades 8 are maintained at the optimum positions since there is friction at the bearings due to centrifugal force of the moving blades 8. However, if a moment to reduce the blade angle (pitch angle reduction moment) is large and there is a possibility that the pitch angle of the moving blade might be change, counter balancers 20 are attached to the blade shafts 7. Moment M1 produced by the centrifugal force of the moving blade 8 is offset by moment M2 produced by the counter balancers 20, whereby the optimum angle of the moving blade 8 is maintained.

Figure 11:
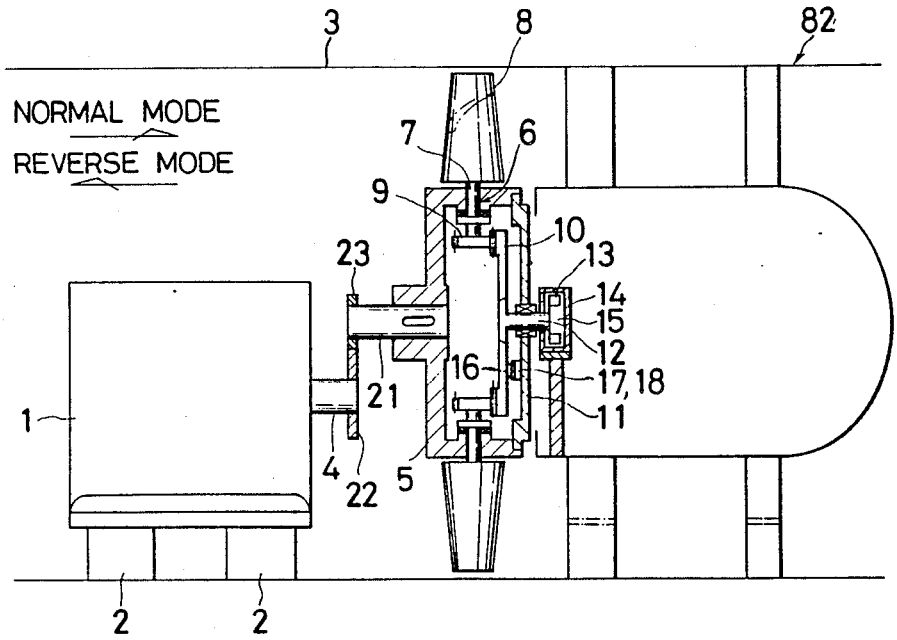
FIGS. 11 and 12 are views showing yet other embodiments of this invention respectively.

Meanwhile, fluid other than oil may be used to fill the casing 14. Also, the blade wheel 5 is not necessarily disposed on the motor shaft 4. For instance, as shown in FIG. 11, when the motor shaft 4 of the blower 82 extends beneath the shaft 21 of the blade wheel 5, the motor 1 and the blade wheel 5 are connected to each other by the gears 22 and 23. In the illustrated case, the rotation response of the blade wheel 5 relative to the rotation of the motor shaft 4 is faster than in the foregoing embodiments, since the gear 22 is larger than the gear 23.

Figure 12:
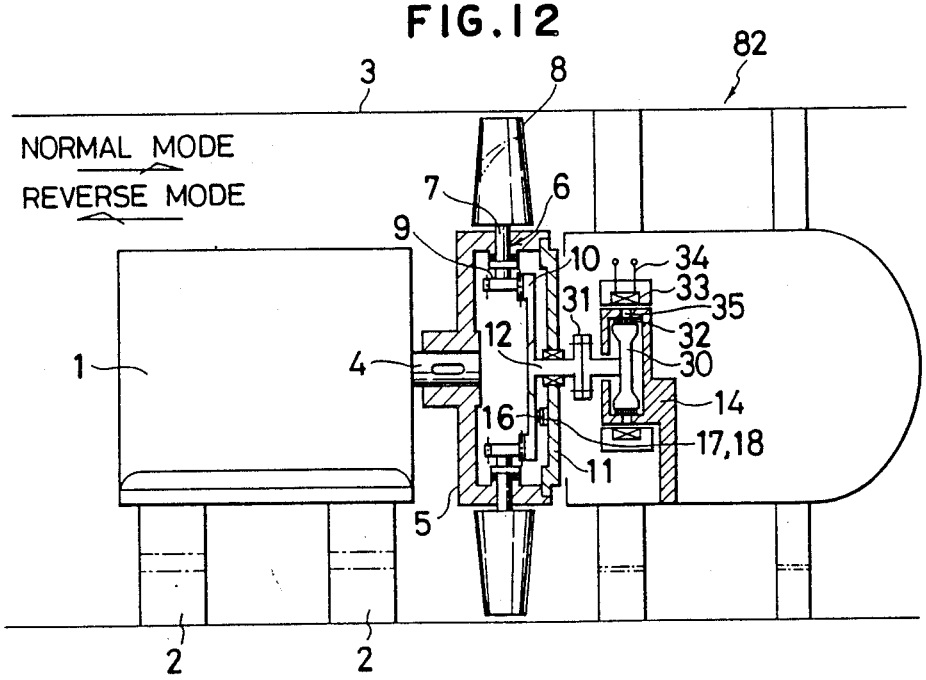

Furthermore, as shown in FIG. 12, an electromagnetic powder clutch may be used in the damping means. In this case, there is a rotor 30 disposed level with the large gear 10, and the rotor 30 is connected to the shaft 12 of the large gear 10 by a coupling 31. The rotor 30 is rotatably housed in the casing 14 fixed to the housing 3 of the blower 82. There is provided magnetic powder 32 between the rotor 30 and the casing 14, and there is provided a coil 33 around the casing 14 along the circumference thereof. Numeral 34 is a connection to the power source (not shown) and numeral 35 is a magnetic flux partition ring. When the electric power is supplied to the coil 33, the magnetic power 32 is excited and becomes solid. Thereupon, the casing 14 and the rotor 30 are connected to each other, so that the rotor 30 is no longer rotatable, stopping the large gear 10. Upon cutting off of the electric power to the coil 33, the magnetic powder 32 returns to a powder state from the above-mentioned solid state, releasing the rotor 30 from the casing 14. The strength of connection between the rotor 30 and the casing 14 by the magnetic powder 32 can be controlled by adjusting the current to be supplied to the coil 33. Moreover, a similar function by the above-described clutch means provided with the damping means is attained by way of the electromagnetic force (for example, by eddy current) excited on the rotor 30 and the casing 14. In this case, the magnetic poweder 32 is not required.

The above embodiments all have following advantages.

(i) It is possible to automatically change the pitch angle of each streamline-shaped moving blade 8 to an optimum angle by use of rotative power of the blower 82, which leads to an effective ventilation. Also, noise is reduced compared with the conventional blowers.

(ii) Since no drive mechanism in addition to the blower 82 is required, the conventional blowers can be modified to the blower of this invention.

What is claimed is:

1. An improved fluid apparatus of the type including a device having a rotative shaft, a blade wheel connected to the rotative shaft, and a plurality of moving blades disposed along the outer circumference of the blade wheel so that the fluid apparatus may produce fluid flow in the direction of the shaft upon rotation of the shaft, each moving blade having a shaft extending in the radial direction of the blade wheel, wherein the improvement comprises:

each moving blade being disposed on the blade wheel so that it may rotate about its own shaft with each shaft extending into the blade wheel;

a small gear secured to each moving blade shaft inside the blade wheel;

a large gear having a shaft and being disposed generally level with the blade wheel so as to engage the small gears;

damping means connected to the shaft of the large gear for slowing the rotation of the large gear so as to produce a relative angle difference between the blade wheel and the large gear upon starting of the fluid apparatus; and, stoppers for stopping the large gear at predetermined positions with respect to the blade wheel in normal and reverse modes of operation of the fluid apparatus respectively.

2. A fluid apparatus according to claim 1, wherein the damping means comprises an impeller disposed at an end of the shaft of the large gear, a casing for housing the impeller, and fluid contained within the casing.

3. A fluid apparatus according to claim 2, including means for disconnecting the shaft of the large gear from the impeller.

4. A fluid apparatus according to claim 3, wherein said means is an electromagnetic clutch.

5. A fluid apparatus according to claim 3, including counterbalancers attached to the moving blades so as to suppress the rotation of the moving blades about their respective shafts.

6. A fluid apparatus according to claim 2, wherein the fluid contained in the casing is oil.

7. A fluid apparatus according to claim 2, wherein each of the moving blades is streamline in section.

8. A fluid apparatus according to claim 1, wherein the blade wheel is fixed to the rotative shaft of the device.

9. A fluid apparatus according to claim 2, wherein the blade wheel is connected to the rotative shaft of the device by gears.

10. A fluid apparatus according to claim 1, wherein each of the moving blades is streamline in section.

11. A fluid apparatus according to claim 1, wherein the blade wheel is fixed to the rotative shaft of the device.

12. A fluid apparatus according to claim 1, wherein the blade wheel is connected to the rotative shaft of the device by gears.

13. A fluid apparatus according to claim 1, including a rotor disposed in the casing so as to be connected to the large gear by coupling means, magnetic powder disposed between the rotor and the casing, and a coil disposed around the casing, so that the magnetic powder is excited to a solid state thereby connecting the rotor to the casing.

14. A fluid apparatus according to claim 1, including a rotor disposed in the casing so as to be connected to the large gear by coupling means, and a coil disposed around the casing, so that the rotor and the casing are connected to each other in a damping manner by way of the electromagnetic force caused by the coil or an eddy current of the coil when electric power is supplied to the coil.

* * * * *